US008839521B2

(12) United States Patent
Hazard

(10) Patent No.: US 8,839,521 B2
(45) Date of Patent: Sep. 23, 2014

(54) HAIR CUTTING APPARATUS

(76) Inventor: Terri D. Hazard, Burbank, CA (US)

( * ) Notice: Subject to any disclaimer, the term of this patent is extended or adjusted under 35 U.S.C. 154(b) by 125 days.

(21) Appl. No.: 13/385,086

(22) Filed: Jan. 31, 2012

(65) Prior Publication Data

US 2012/0192427 A1 Aug. 2, 2012

Related U.S. Application Data

(60) Provisional application No. 61/519,226, filed on May 18, 2011, provisional application No. 61/462,364, filed on Feb. 1, 2011.

(51) Int. Cl.

| | |
|---|---|
| ***B26B 21/12*** | (2006.01) |
| ***B26B 21/40*** | (2006.01) |
| ***B26B 21/52*** | (2006.01) |
| ***B26B 21/42*** | (2006.01) |
| ***A45D 24/36*** | (2006.01) |

(52) U.S. Cl.

CPC ..... *B26B 21/527* (2013.01); *B26B 21/4006* (2013.01); *B26B 21/12* (2013.01); *B26B 21/42* (2013.01); *A45D 24/36* (2013.01); *B26B 21/4081* (2013.01)

USPC ..... 30/30; 30/296.1; 30/298; 30/291

(58) Field of Classification Search

USPC ..... 30/30, 296.1, 298, 291, 340, 342, 349

See application file for complete search history.

(56) References Cited

U.S. PATENT DOCUMENTS

| | | | | |
|---|---|---|---|---|
| 1,455,621 | A | 6/1921 | Joyner | |
| 1,587,656 | A | 5/1925 | Kojima | |
| 2,359,098 | A * | 9/1944 | Engle | 30/144 |
| 2,636,265 | A | 12/1949 | Sineed | |
| 2,896,320 | A | 1/1955 | Caplan | 30/30 |
| 4,037,322 | A * | 7/1977 | Bresler | 30/53 |
| 4,363,147 | A * | 12/1982 | Deweese | 7/158 |
| 4,542,585 | A | 9/1985 | Ito et al. | 30/210 |
| 4,663,841 | A * | 5/1987 | Custer | 30/30 |
| 4,817,221 | A | 4/1989 | Ryan | 7/148 |
| 5,220,728 | A | 6/1993 | Ueno et al. | 30/30 |
| D407,527 | S | 3/1999 | Bellisario | D28/25 |
| 5,934,291 | A * | 8/1999 | Andrews | 132/215 |
| 6,029,356 | A | 2/2000 | Sprinkel | 30/28 |
| 6,092,288 | A | 7/2000 | Adachi | 30/53 |
| D431,095 | S | 9/2000 | Hyman | D28/45 |
| 6,267,117 | B1 * | 7/2001 | Bisson | 132/200 |
| D482,492 | S | 11/2003 | Cheung | 28/44 |
| D484,769 | S | 1/2004 | Cheung | D8/98 |
| D547,005 | S | 7/2007 | Granito | 28/25 |
| D612,102 | S | 3/2010 | Kling et al. | 28/48 |
| D635,301 | S | 3/2011 | Cormier | D28/46 |
| D665,533 | S | 8/2012 | Hazard | D28/44 |
| 2009/0235529 | A1 * | 9/2009 | Ringart et al. | 30/30 |
| 2011/0016734 | A1 | 1/2011 | Kludjian et al. | 30/526 |
| 2011/0131811 | A1 * | 6/2011 | Hirano | 30/30 |

* cited by examiner

*Primary Examiner* — Omar Flores Sanchez

(74) *Attorney, Agent, or Firm* — Michael B. McMurry

(57) ABSTRACT

Described is a hand held hair cutting apparatus that includes a razor blade holder with four finger holes extending through the holder. A razor blade, either straight or arched, can be attached to one edge of the holder. allowing the razor to be easily changed. Placing fingers through the holes in the holder allows a user to securely hold tool using four fingers. The apparatus can also be configured with three finger holes and a finger rest for end finger.

5 Claims, 5 Drawing Sheets

3A
3A
54
49
38
10
62
15

40
38
36

HAIR CUTTING APPARATUS

CROSS-REFERENCE TO RELATED APPLICATIONS

This patent application claims priority on provisional patent applications: Ser. No. 61/519,226, filed May 18, 2011; and Ser. No. 61/462,364, filed Feb. 1, 2011.

FIELD OF THE DESCRIBED APPARATUS

The described apparatus and methods relate generally to human hair cutting.

BACKGROUND

Most hair styling or razor cutting devices are composed of a razor with stem handle which is held by a stylist between the thumb and forefinger that does not allowing the stylist to maintain pressure accurately and evenly across the shafts of the hair. This hair cutting technique has a number the disadvantages. For example, this approach typically results in more hair being removed on the side the handle is being held due to the inability of the slyest to consistently stabilize the pressure distribution to the cutting surface. As a result, certain hair cutting techniques such as texturizing and the creation of certain hair styles can be difficult or impossible. Also, because of the unbalanced nature of these types of devices, significant stress can result on parts of the hand and wrist of the individuals using devices.

Examples of other types of hair cutting devices are shown in U.S. Pat. Nos. D484,796, 1,587,656, 2,636,265, and 6,267,117. The various devices described in these patents suffer from a number of the same or similar limitations in both in the nature of the cuts that can be performed or in the difficulty in using the device.

SUMMARY

Described is an apparatus and method of cutting hair using a razor mounted in a blade holder having four apertures enabling a stylist to grasp the holder in one hand and a strand of an individual's hair in the other and stylize the hair by moving the holder downwardly along the strand away from the individual's head.

DETAILED DESCRIPTION

Figure 1:
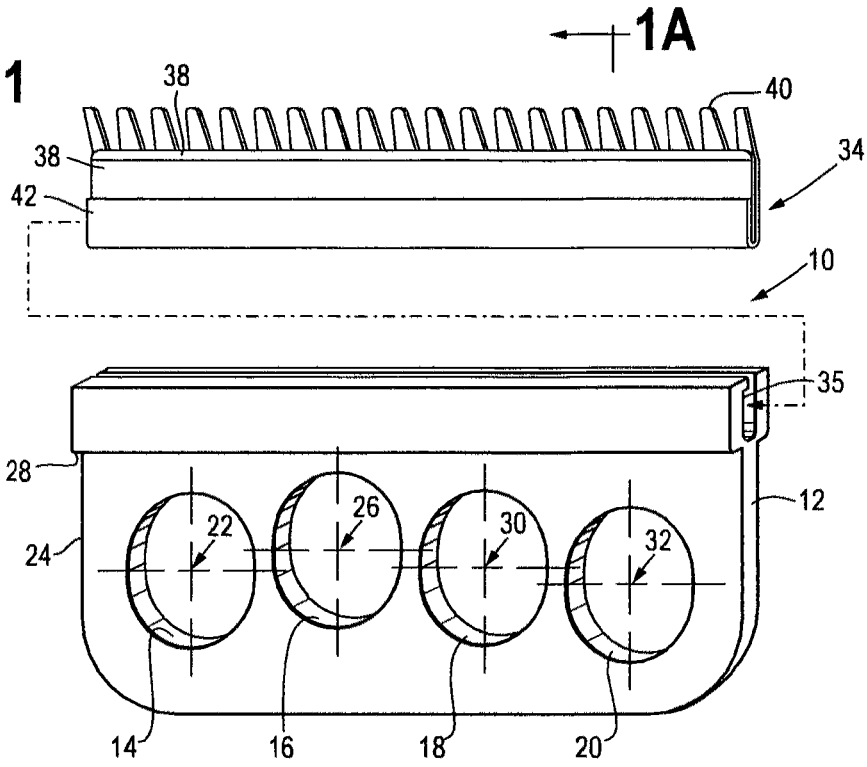
FIG. 1 is exploded perspective view of a first embodiment of a hair cutting apparatus.

FIG. 1 is a depiction of the preferred embodiment of a hair cutting apparatus 10 that includes a generally rectangular blade holder 12. Located in said blade holder 12 are set of four generally elliptically shaped finger holes or apertures 14-20. The apertures 14-20 are preferably configure to permit a stylist or user to easily insert the fingers on one hand through the apertures 14-20 and to be able to maintain a firm grip on the holder 12. In addition the apertures 14-20 are preferably positioned on said blade holder 12 in such a manner to provide for a balanced hair cutting tool where the weight of the hair cutting apparatus is evenly distributed across the user's fingers along with natural finger positioning.

As shown in FIG. 1, the preferred aperture location includes the first 14 of said apertures centered at a first position 22 in the blade holder 12 along a first side 24 of the blade holder 12; a second of the apertures 16 centered at a second position 26 in the blade holder 12 next to said the aperture 18 and closer to an upper portion 28 than said first aperture 14; the third 18 of said apertures centered at a third position 30 in the blade holder 12 next to the second aperture 16 closer to said upper portion 28 than the first aperture 14; and the fourth 20 of the apertures centered at a fourth position 32 in the blade holder 12 next to said third aperture and further away from the upper portion 28 than said second apertures 16 and 18. Also, in the preferred embodiment, the center position of the third aperture 18 is further away from the upper portion 28 than said second apertures 16. This positioning of the finger holes or grips 14-20 permits an ergonomically correct positioning of the hand while using said apparatus 10. Preferably, the blade holder 12 is fabricated out of a single block of material such as aluminum, plastic or a zinc alloy.

Figure 1A:
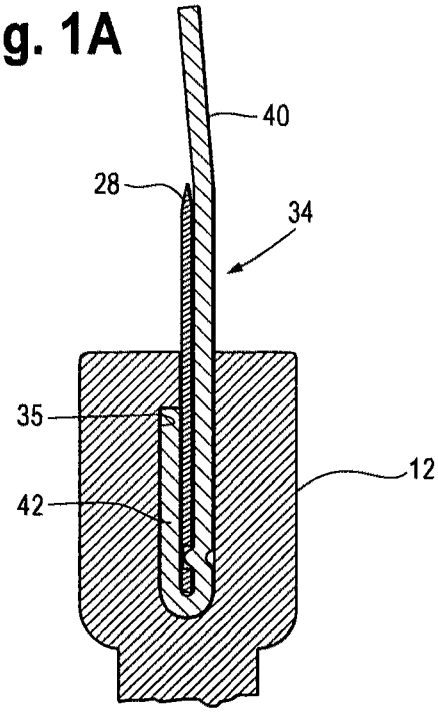
FIG. 1A is a side view of a comb-blade assembly for use with the hair cutting apparatus of FIG. 1.

FIG. 1A is a side view of a preferred embodiment of a comb-blade assembly 34 for insertion in a slot 36 of the blade holder 12. Included in the comb-blade assembly 34 is a straight razor blade 38 which is secured to a comb 40. The assembly 34 can also include a support member 42 which in this case is formed from a U-shaped portion of the comb 40. Various other arrangements can be used to secure a blade and comb assembly in a blade holder such as shown in U.S. Pat. No. 5,220,728.

Figure 2:
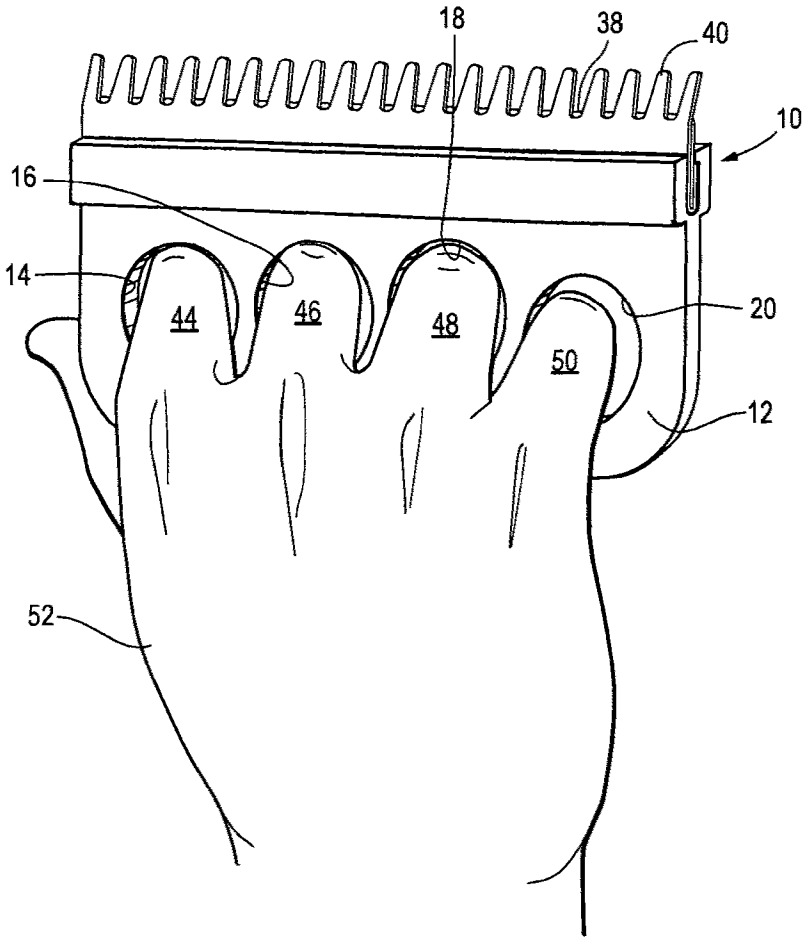
FIG. 2 is a view of a manner of grasping the hair cutting apparatus of FIG. 1.

FIG. 2 is a perspective view of the hair cutting apparatus 10 with a user's fingers 44-50 on one hand 52 inserted through the apertures 14-20.

Figures 3, 3A:
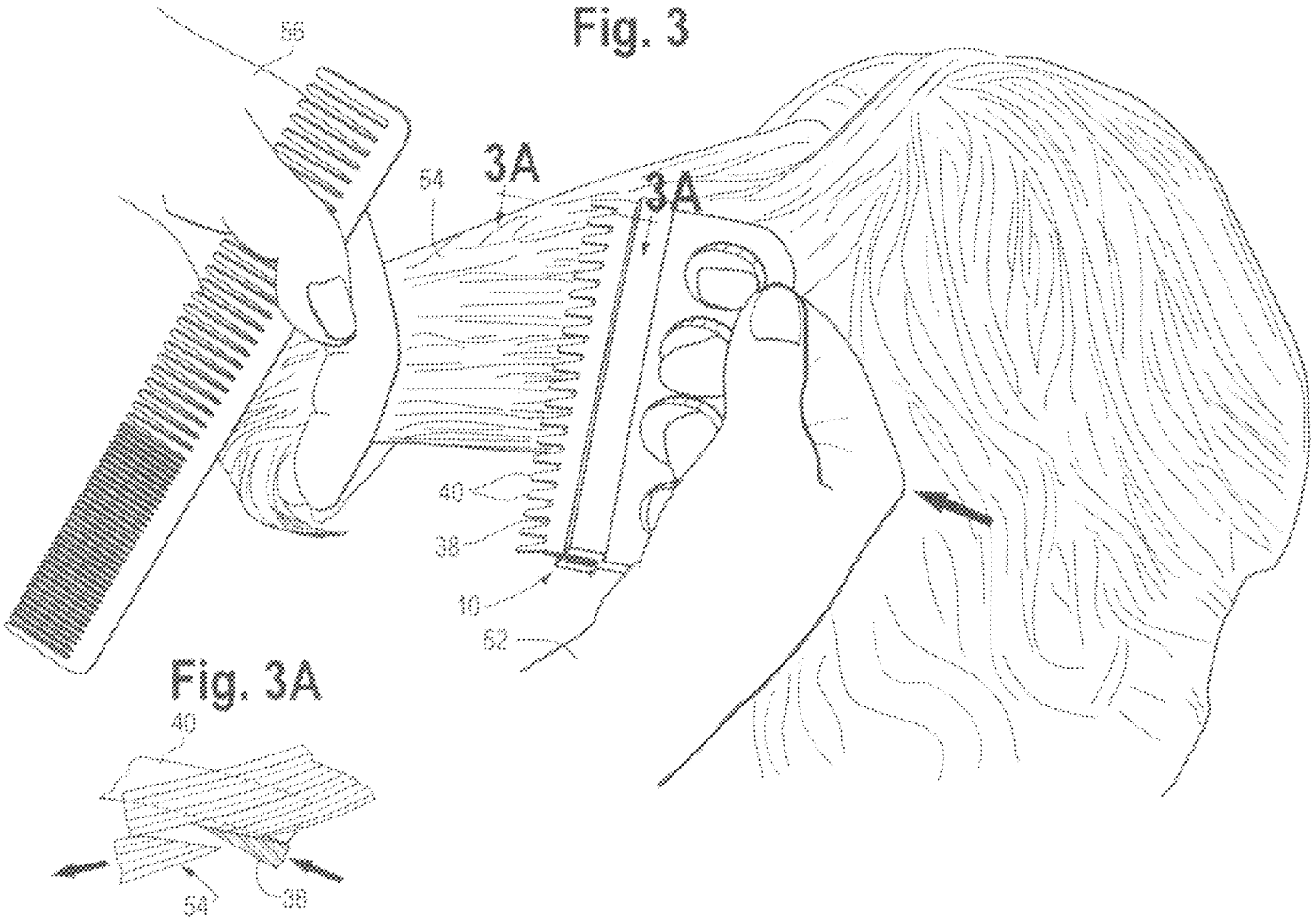
FIG. 3 is an illustration of a method of using the hair cutting apparatus of FIG. 1.
FIG. 3A is a sectioned side view of the hair cutting apparatus taken along the direction as indicated by a line 3A as shown in FIG. 3.

FIG. 3 is an illustration of a method of using the hair cutting apparatus 10. As shown in FIG. 3, a hair stylist can grasp the blade holder 12 by inserting her fingers 44-50 of the hand 52 through the apertures 14-20, hold a strand 54 of a client's hair with the other hand 56 and move the apparatus 10 downwardly along the strand 54 away from the client's head. As shown in FIG. 3, using the apparatus 10 with the hand 52 palm down, such that the blade 38 engages the top portion of the strand 54, will result in shorter pieces of hair on the top portion of the strand 54. Similarly, using the apparatus 10 with palm side up with the blade 38 engaging the underside of the strand creates shorter hair in the underneath portion of the strand 54. Generally, the amount of hair that will be removed from the strand 54 in each such operation will be determined by the amount of blade pressure applied to the strand 54.

To texturized, or remove bulk from the client's hair, the apparatus 10 is used by taking the strand 54; placing the apparatus 10 midway through the strand 54 with the blade 38 facing the ends of the hair and then gliding the blade 38 across the hair in the strand 54. This can create empty spaces or air pockets that will allow the hair to move more easily and temporarily eliminate unwanted density.

Figure 4:
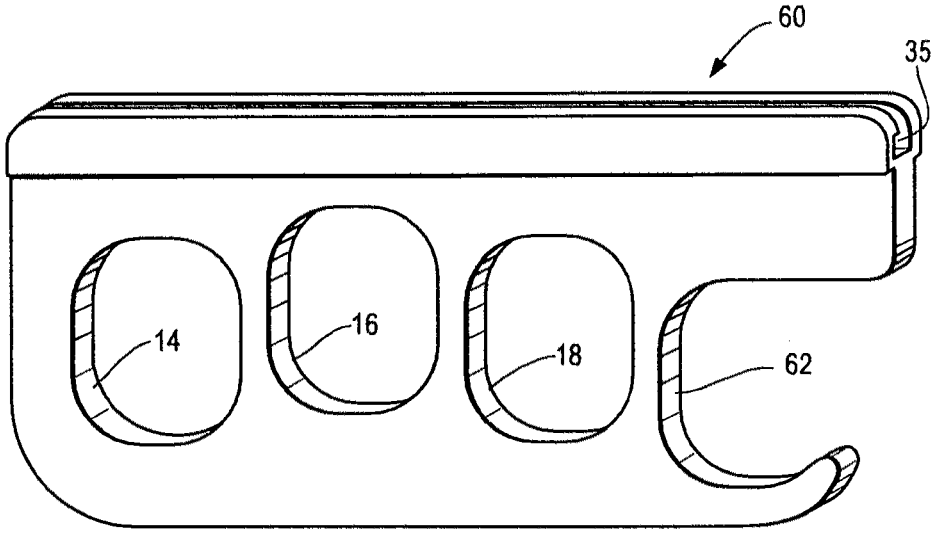
FIG. 4 is a perspective view of a second embodiment of the hair cutting apparatus.

FIG. 4 is a front perspective view of a second embodiment 60 of a blade holder. It is similar to the blade holder 12 of FIG. 1 except it is configured with a notch 62 at one end instead of an aperture of the type 20 to receive a user's finger.

Figure 5:
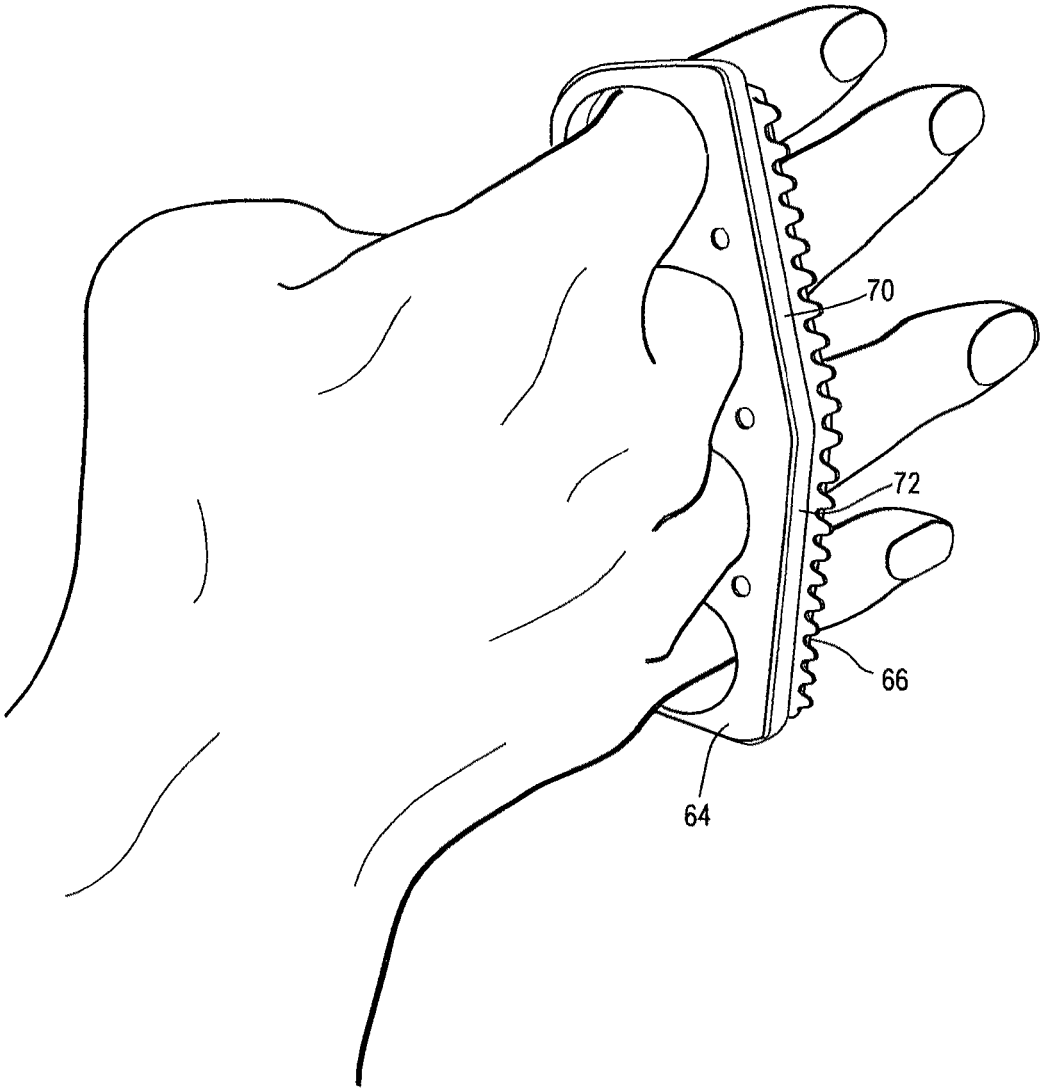
FIG. 5 is a plan view of the second embodiment of the hair cutting apparatus and a manner of holding same.

FIG. 5 is a perspective view of a second embodiment 64 of a hair cutting apparatus being held by a user. In this embodiment, a V-shaped or arcuate comb and blade assembly 66 is used rather than the straight blade assembly 34 of FIGS. 1-3. In this particular embodiment, the blade comb assembly 66 approximates an arch by utilizing two separate linear blade comb combinations 70 and 72 which are secured to a blade holder 74 by a number of fasteners as shown. Alternately, the comb blade can be fabricated using curved blades and comb members. While the straight blade is the preferred embodiment, there can be certain situations where a blade having arcuate shape can be of advantage.

The hair cutting apparatus 10 as described above permits a stylist to cut hair at a fast and efficient pace, as it can glide through each section or strand of hair quickly. Stress on parts of the hand and wrist that hair cutters typically experience in using other tools is substantially reduced or eliminated. Also, by permitting a stylist to use the entire arm to perform the motions necessary to style hair, substantially alleviates pressure on the hand and wrist that typically occur using other cutting devices to achieve similar results.

I claim;

1. A method for cutting the hair of an individual comprising the steps of:

grasping with a first hand a hair cutting device having a razor blade holder with a razor blade secured to one edge of said razor blade holder by inserting each of the four fingers said first hand through a set four apertures configured across the width of a razor blade holder such that said razor blade faces away from the palm of said first hand;

holding a section of the individual's hair with a second hand;

placing said hair cutting device in contact with the shafts of said section; and applying a predetermined amount of pressure via said razor blade handle to said hair shafts moving said razor blade along said strand such that said razor blade is effective to cut a selected portion of the hair in said strand.

2. The method of claim 1 wherein said step of moving includes holding said razor blade palm side up such that said strand is cut from its underside resulting in shorter hair on the underneath portion of said strand.

3. The method of claim 1 wherein said step of moving includes holding said razor blade palm side down such that said strand is cut from its upper side resulting in shorter hair on the upper portion of said strand.

4. The method of claim 1 wherein the hair is texturized by utilizing said razor blade holder to position said razor blade midway on said section facing the ends of the hair in said section and moving said blade across the hair in the said section.

5. The method of claim 1 wherein, in said step of moving said hair cutting device downwardly along and in contact with said section, using the entire arm and keeping the wrist of said first hand straight.

* * * * *